United States Patent [19]

Trin Dinh et al.

[11] 4,125,566

[45] Nov. 14, 1978

[54] PROCESS FOR UPGRADING EFFLUENTS FROM SYNTHESES OF THE FISCHER-TROPSCH TYPE

[75] Inventors: Chan Trin Dinh, Le Vesinet; Jean-Francois Le Page, Rueil Malmaison; Jean Cosyns, Maule; Germain Martino, Poissy; Jean Miquel, Paris, all of France

[73] Assignee: Institut Francais du Petrole, France

[21] Appl. No.: 825,357

[22] Filed: Aug. 17, 1977

[30] Foreign Application Priority Data

Aug. 17, 1976 [FR] France ..... 76 25146

[51] Int. Cl.[2] ..... C07C 1/04; C10G 7/06; C10G 37/10

[52] U.S. Cl. ..... 260/676 R; 44/80; 208/17; 208/93; 260/450

[58] Field of Search ..... 208/93; 260/450, 676 R

[56] References Cited

U.S. PATENT DOCUMENTS 2,678,263 5/1954 Glazier ..... 208/17

FOREIGN PATENT DOCUMENTS 1,094,902 12/1960 Fed. Rep. of Germany ..... 260/450

*Primary Examiner*—Herbert Levine
*Attorney, Agent, or Firm*—Millen & White

[57] ABSTRACT

This process applies to effluents from syntheses of the Fischer-Tropsch type; it comprises several treatments applied to the three cuts obtained from these effluents, i.e. a "light fraction", a "light oil" and a "decanted oil". These treatments comprise such steps as distillation, polymerization, alkylation, hydrotreatment, cracking-decarboxylation, isomerization and hydro reforming. The products are mainly gasoline, kerosene and gasoil.

5 Claims, 1 Drawing Figure

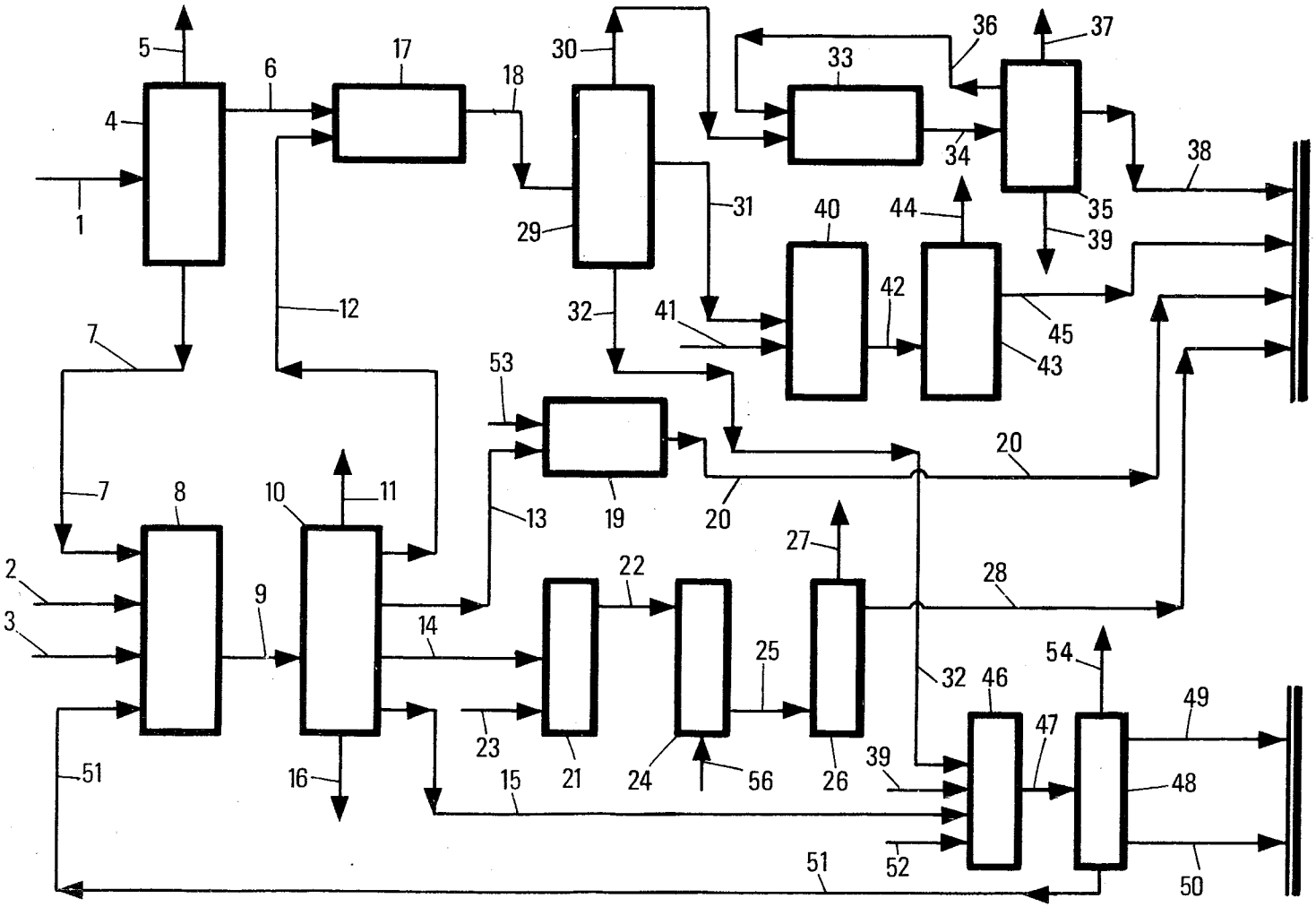
1
2
3
4
5
6
7
7
8
9
10
11
12
13
14
15
16
17
18
19
20
20
21
22
23
24
25
26
27
28
29
30
31
32
32
33
34
35
36
37
38
39
39
40
41
42
43
44
45
46
47
48
49
50
51
51
52
53
54
56

PROCESS FOR UPGRADING EFFLUENTS FROM SYNTHESES OF THE FISCHER-TROPSCH TYPE

During the past years, oil has gained an important and often major position among the power sources.

The successive increases of the oil price during the last years have obliged to consider the development and use of other power sources, such as coal, shales, etc. which were previously considered insufficiently profitable.

A fairly long time, ago, techniques for producing liquid hydrocarbons from solid combustibles and particularly from coal have been studied and used in countries which have no exploitable oil fields on their ground.

For example, solid combustible may be hydrogenated under pressure, according to the two following techniques:

catalytic hydrogenation of the pulverized combustible in one single step. A mixture of liquid hydrocarbons may thus be obtained (for example, Synthoil, H-Coal. . . processes), treatment in two successive steps: the first (not catalytic) operation comprises dissolving the combustible into a solvent material in the presence of hydrogen. The resulting mixture is then catalytically hydrogenated (for example: Pittsburg Midway, Consol . . . processes).

Coal may also be converted to gas, thus yielding a gas mixture which may be catalytically converted to liquid and gaseous hydrocarbons having the same uses as oil and its derivatives.

These various hydrogenation processes, or other processes, such as the Fischer-Tropsch synthesis, yield practically sulfur-free products (pollution problems are thus avoided) and also complex products which may contain, in addition to hydrocarbons, aldehydes, ketones, fatty acids, esters and other carboxy compounds. It is thus necessary, when upgrading these products, to treat them in convenient manner to obtain a maximum of useful fractions such as gasoline, kerosene and gasoil fractions; this is the object of the present invention.

According to the invention, the complex mixture obtained in a Fischer-Tropsch synthesis reactor is treated in a fractionation zone to obtain various fractions, each of which is thereafter treated separately to obtain industrially useful products of increased value. An object of this invention is to produce gasoline, kerosene and gas-oil, the production of gasoline being as high as possible.

The charges obtained from units for the catalytic conversion of products resulting from gasifying coal (Fischer-Tropsch and analogous conversions) have different compositions depending on the different variables intervening in the processes which have been used to produce these charges, these variables being, for example, the catalysts, pressures, temperatures, the manner to employ the catalyst, etc...

The resulting liquid products to be used as charges in the process according to the invention may have, for example, compositions ranging usually within the following domains (by weight):

| | | | | |
|---|---|---|---|---|
| $C_3 - C_4$ | from | 4 | to | 30% |
| $C_5$ to $C_{11}$ | from | 30 | to | 75% |
| $C_{11}$ and higher ($C_{11}^+$) | from | 3 | to | 15% |
| Oxygen compounds | from | 4 | to | 15% |
| Organic acids | traces | | to | 2% |

-continued

| | | | |
|---|---|---|---|
| with an olefin percentage from about | 40 | to | 75% |

The present invention concerns a process for upgrading effluents from syntheses of the Fischer-Tropsch type or from syntheses of a similar type, these effluents usually consisting of three cuts of very high olefinic compounds content. The so-called "light fraction" or first cut consists mainly of hydrocarbons having from 3 to 6 carbon atoms per molecule, these hydrocarbons being largely unsaturated hydrocarbons; the so-called "light oil" or second cut consists largely of hydrocarbons whose lightest may have, for example, 5 carbon atoms per molecule and heaviest a final ASTM distillation point of about 300° C.; the so-called "decanted oil" or third cut consists largely of hydrocarbons of ASTM distillation point higher than about 300° C.; each of the three cuts also contains oxygen compounds. The process characterizes in that the so-called light fraction is first subjected to fractrionation to eliminate a fraction comprising hydrocarbons with 5 or more carbon atoms per molecule and oxygen compounds, and then passed to a polymerization zone in admixture with a fraction defined later, and the effluent from the polymerization zone is then supplied to a fractionation zone to recover ($\alpha$) a fraction having a high content of relatively light olefins and paraffins, ($\beta$) a fraction of high gasoline content which may be collected as final product and ($\gamma$) a fraction of high kerosene and gasoil content to be treated as hereinafter stated. The process also charaterizes in that the so-called "light oil" and "decanted oil" fractions and the fraction comprising hydrocarbons with 5 or more carbon atoms per molecule and oxygen compounds, as obtained by fractionation of the so-called "light fraction" cut, all are together subjected to a so-called cracking or cracking-decarboxylation treatment, followed with fractionation of the products recovered from this cracking, in order to obtain, among others, (a) a cut containing olefins with 3 and 4 carbon atoms per molecule, the latter cut being supplied to said polymerization zone, (b) a cut containing unsaturated hydrocarbons with 5 and 6 carbon atoms per molecule, this cut being supplied to an isomerization zone to improve its octane rating (by isomerization of the double bond), (c) a cut essentially containing hydrocarbons with 7 to 10 carbon atoms per molecule, the latter cut of very high olefinic compound content being supplied to a hydrotreatment zone and then to a hydroforming zone to produce highgrade motor gasoline, (d) a cut containing hydrocarbons ranging from those having 11 carbon atoms to those having an ASTM final distillation point of about 360° C. or more, said cut being admixed with said fraction ($\gamma$) of high kerosene and gas oil content, as obtained by fractionation of the products formed in said polymerization zone, and subjected to hydrotreatment and then fractionation in order to collect among others a kerosene fraction and a gas oil fraction.

The object of the present invention, as illustrated by the single non-limitative figure, is to subject the products discharged from a process of the Fischer-Tropsch synthesis type to a plurality or a series of conversions, to yield products having substantially better use and value than those obtained by using, as such or after simple fractionation, the raw products obtained from synthesis of the Fischer-Tropsch type, since these products would contain substantial amounts of hardly utilizable products.

The various operations which can be combined in the process of the present invention are: distillation, polymerization, alkylation, cracking, hydrogenation, decarboxylation, isomerization, reforming, etc.

The raw materials to be treated, which may be supplied from units of the Fischer-Tropsch synthesis type, consist usually of 3 distinct fractions: a light fraction, an intermediate fraction and a heavy fraction. Since the raw materials consist of a complex mixture of various chemical species, particularly as concerns the light fraction containing saturated and unsaturated light hydrocarbons, it is essential to subject them first to fractionation, for example by distillation, in order to obtain the above three individual cuts, i.e.:

1/ - a "light fraction" cut containing, for example, hydrocarbons having from 3 to 6 carbon atoms per molecule and oxygen compounds (such as carboxy compounds), this cut being fed to pipe 1.

2/ - a "light oil" cut containing, for example, hydrocarbons whose lightest have 5 carbon atoms per molecule and heaviest an ASTM final distillation point of 300° C. (the maximum boiling point of the cut is about 300° C.), and also containing oxygen compounds (for example, carboxy compounds) which cut is fed to pipe 2.

3/ - a heavier cut called "decanted oil" whose distillation point is, for example, from 200° to 500° C. and containing oxygen compounds, which cut is fed to pipe 3.

The first so-called $C_3$–$C_6$ "light cut" has usually a very high content in olefinic hydrocarbons which are first fractionated in zone 4. A gas fraction, usually in very low amount by volume, is recovered from the top through pipe 5. A $C_3$–$C_4$ fraction is recovered through pipe 6 and a heavier fraction usually of the $C_5^+$ type, with carboxy compounds through pipe 7, said fraction being treated with the other two heavier fractions of pipes 2 and 3, as recovered from the synthesis of the Fischer-Tropsch type. The $C_3$–$C_5$ fraction of pipe 6, together with another fraction from pipe 12, as hereinafter defined, is supplied to a polymerization zone 17 so as to obtain a product of high gasoline, kerosene and gas oil content to be discharged through pipe 18.

The polymerization reactions are performed in that zone 17 under conventional conditions, in the presence of a catalyst, for example in fixed bed, at a temperature of from about 100° to 400° C., under a pressure of from about 1 to 200 kg/cm$^2$ at a liquid hydrocarbon feed rate (space velocity) of about 0.05 to 5 volumes per volume of catalyst per hour. The catalyst of acid type is selected, for example, from silica-alumina, silica-magnesia, boron-alumina, phosphoric acid on quartz, mixtures of alumina gel with thoria, with optional addition of small amounts of chromium oxide or equivalent metal. A catalyst of the "solid phosphoric acid" type may also be used i.e. a catalyst consisting of silica containing material of high absorption power, impregnated with a large amount of phosphoric acid. Catalysts obtained by treatment of transition alumina with an acidic fluorine compound, with optional addition of a silicic ester, may also be used.

The product obtained at the outlet from the polymerization zone is then passed through pipe 18 to zone 29 where it is subjected to fractionation in order to separate and obtain valuable products. Particularly there is recovered, on the one hand, through pipe 31, a gasoline fraction (containing $C_5^+$ with an ASTM final distillation point lower than about 200° C.) which may be subjected, before its use as gasoline, to hydrotreatment in the presence of hydrogen in zone 40 (in the presence of hydrogen supplied from pipe 41 and of a conventional hydrogenation catalyst, at about −20 to 400° C., under a pressure between 1 and 90 kg/cm$^2$, with a ratio $H_2$/HC between about 0.05 and 3), so as to eliminate the traces of actual and potential gums, and on the other hand a heavy fraction of ASTM initial distillation point higher than 200° C., which is passed through pipe 32 to another hydrotreatment zone 46, admixed with a fraction from a "fluid catalytic cracking" step (FCC-decarboxylation) as hereinafter explained.

The product discharged from the hydrotreatment zone 40 through pipe 42 is high-grade gasoline. If desired, this product may be fractionated in zone 43 to eliminate a top light gas fraction through pipe 44, while the proper gasoline fraction is discharged through pipe 45.

From the top of the fractionation zone 29, there is further recovered through pipe 30 a fraction containing olefins and paraffins (LPG), which are all $C_3$ and $C_4$ hydrocarbons. As the conversion is not complete in the polymerization zone 17, there is collected at the top of the fractionation zone 29 a fraction containing unreacted olefins and also paraffins (normal and mainly isoparaffins, for example isobutane).

It has been found that it was advantageous to pass this mixture of paraffins and olefins to an alkylation reactor 33 under appropriate conditions of temperature, pressure and space velocity, in the presence of a convenient catalyst. The alkylation reaction is usually carried out in the presence either of a solid catalyst used in fixed bed or of a dissolved catalyst, i.e. in liquid phase, at a temperature between −20° and 200° C., under a pressure of 0.1 to 200 atmospheres. It is thus possible to proceed in the liquid phase in the presence of a strong inorganic acid such as hydrofluoric or sulfuric acid with or without addition of a Lewis acid such as boron trifluoride, antimony pentafluoride or aluminum trichloride and/or in the optional presence of a Bronsted acid. The operation may also be conducted in vapor phase in the presence of solid catalysts of the polyvalent metal phosphate, arseniate or stannate type, with added boron trifluoride. Alkylation processes effected in the presence of catalysts having a zeolitic structure are now available, with molecular sieves, with or without silica-alumina or alumina, for example, optionally with at least one metal such as nickel, palladium, rhodium, platinum, with molybdenum or uranium oxides, or with activated earths, etc . . . .

More particularly, the alkylation reaction is carried out at temperatures close to room temperature at moderate pressures.

An alkylate is thus obtained during the alkylation; it is discharged through pipe 34 and may be fractionated in zone 35 to obtain:

LPG which is discharged through pipe 37; it contains saturated hydrocarbons (iso or normal paraffins) with 3 or 4 carbon atoms per molecule, an optional fraction (pipe 36) discharged either from the top of the fractionation zone 35, as shown in FIG. 1, or from pipe 37; it has a high isobutane content and may be recycled to the alkylation zone, an alkylate, useful for example as motor gasoline, since the alkylation products have usually a clear octane number between 88 and 95. This alkylate is discharge through pipe 38, a minor residue which is discharged through pipe 39.

The residue of the latter distillation conveyed through pipe 39 contains hydrocarbons heavier than $C_4$ ($C_9^+$, for example) and may be usefully added to the two other heavier cuts recovered from the synthesis of the Fischer-Tropsch type, i.e. to the cuts of lines 2 and 3. This residue may also be fed to the hydrotreatment zone 46 as hereinafter defined.

The second "light oil" cut and the third "decanted oil" cut are treated as follows. these second and third cuts contain, in addition to hydrocarbons, an amount of oxygen-containing hydrocarbon products, such as alcohols, aldehydes, acids, etc.

To upgrade these products, they are subjected to decarboxylation (or cracking) in order to convert the oxygen-containing products to hydrocarbons.

The mixture of these products is thus passed through a cracking unit 8 in the presence of an appropriate catalyst. It is reminded that zone 8 is also used to treat the residue from the zone 4 for fractionating the light cut $C_3$–$C_6$, this residue being fed to zone 8 through pipe 7. It is also reminded that zone 8 may also be used to treat at least a portion of the residue (pipe 39) from the distillation of the product recovered from the alkylation carried out in zone 35. At least one part of this residue may also be fed from line 39 into the hydrotreatment zone 46.

The cracking or decarboxylation zone 8 (FCC, "fluid catalytic cracking") is operated at a temperature usually between 400° and 1200° C. at a space velocity of 2 to 10 volumes of liquid charge per volume of catalyst and per hour. The catalyst is arranged in fixed, moving or fluidized bed. A moving or fluidized bed is used by preference in order to maintain the catalyst in a state of optimal activity and selectivity and to prevent too large coke formation. A solid catalyst with acid properties is used, selected for example from silica-alumina, silica-magnesia, boria-alumina, silica-zirconia, alumina with elements confering acidic properties, natural earth and minerals such as bentonite, hallosite, etc. Traces of chromium or equivalent metal may be optionally introduced into these solid masses to catalyze carbon combustion when regenerating the catalyst. Various zeolites are now used as catalysts, such as those of the aluminosilicate type (various ZMS, for example) or zeolites of the faujasite type and/or sieves of the X and Y types, etc. These catalysts, as used in the cracking zone, are usually employed as tablets or finely divided powder, for example as microspheres.

The products discharged through pipe 9 from the cracking (FCC) unit, when subjected to distillation in zone 10, yield:

an amount of uncondensable gas used as fuel (pipe 11), (containing hydrocarbons having less than 3 carbon atoms per molecule), a condensable gas cut of high $C_3$ and $C_4$ olefin content, which is supplied through pipe 12 to the polymerization unit 17, where it is polymerized in admixture with the $C_2$–$C_4$ cut recovered through pipe 6 from the light fraction, as hereinbefore explained, a light cut containing exclusively hydrocarbons with 5 and 6 carbon atoms per molecule (pipe 13), a heavy gasoline cut comprising hydrocarbons with 7 to 10 carbon atoms per molecule (pipe 14), a heavier cut comprising hydrocarbons ranging from those with 11 carbon atoms per molecule up to those having an ASTM final distillation point of 360° C., or even more, i.e. up to 380° C., for example, this cut being discharged through pipe 15, a residue of tar and other heavy products, discharged through duct 16 and which cannot be recycled.

The light cut containing exclusively hydrocarbons with 5 and 6 carbon atoms per molecule has a high content of olefins, most of them being alpha-olefins; it is however known that the octane rating of olefins of this type is quite lower than that of the other isomers. Thus, according to the invention, this cut is fed through duct 13 to a zone 19 for isomerizing the olefinic double bond, so as to optimize its octane member and collect a fraction (duct 20) to be added to the motor gasoline pool.

This reaction of olefinic double bond isomerization is effected under conventional conditions, in the presence of a catalyst, for example, in the form of a fixed, moving or fluidized bed, at a temperature between about 0° C. and 400° C., under a pressure of about 1 to 20 bars and at a liquid hydrocarbon feed rate (space velocity) of about 1 to 20 volumes of hydrocarbon per volume of catalyst and per hour. The catalyst generally comprises a metal, preferably from group VIII of the periodic classification of the elements (for example cobalt, nickel, palladium, etc.) deposited on a carrier, preferably of low acidity, for example, transition alumina, silica, etc. with a specific surface between about 20 and 300 $m^2$ per gram and a pore volume between about 0.20 and 0.80 cc per g.

The catalyst may work in a sulfurized (to inhibit the hydrogenating properties of the metal) or unsulfurized medium; in order to avoid a loss of the catalytic properties of the solid, it is preferred to operate under partial hydrogen pressure (hydrogen supplied through pipe 53), the hydrogen/hydrocarbon ratio being usually between 0.01 and 2 (this ratio is expressed in mole per mole).

The heavy gasoline cut containing hydrocarbons with 7 to 10 carbon atoms, discharged through pipe 14, is so treated as to be transformed into high grade motor gasoline.

The heavy gasoline cut is subjected to hydrotreatment in zone 21 also fed with hydrogen through pipe 23, the effluent from the hydrotreatment zone being then passed to a reforming zone 24 fed with hydrogen through duct 56.

The hydrotreatment in zone 21 has for object to hydrogenate the heavy gasoline cut to a certain extent, in order to eliminate certain constituents thereof, such as diolefins and oxygen derivatives which would be detrimental to the reforming catalyst of zone 24.

This hydrotreatment is conducted in the presence of a conventional hydrogenation catalyst, at a temperature between −20° and 450° C., under a pressure between 1 and 90 kg/$cm^2$, with a molar ratio $H_2$/HC between 0.05 and 3.

The appropriate operating conditions for reforming reactions in zone 24 are as follows:

temperature usually between 300° and 600° C. and preferably between 450° and 580° C., pressure between about 5 and 20 bars, hourly space velocity between about 0.5 and 10 volumes of liquid charge per volume of catalyst per hour, molar ratio of hydrogen to hydrocarbons between about 1 and 10.

It is operated in the presence of a reforming catalyst comprising as a rule, a carrier, a halogen and one or more metals, for example one or more noble metals from group VIII with or without promoter metal, the promoter consisting itself of one or more metals selected from any group of the periodic classification of the elements.

The catalyst may be employed in fixed, fluid or moving bed.

The reformed cut is discharged through pipe 25 and fed to the fractionation zone 26 to eliminate any hydrogen formed during reforming as well as, if any, the hydrocarbons lighter than butanes which have also formed during reforming. The resulting gasoline is fed to the gasoline pool through pipe 28.

As to the heaviest cut discharged through pipe 15 from the fractionation zone 10 and which contains hydrocarbons with more than 11 carbon atoms per molecule, it is passed to the hydrotreatment zone 46 fed with hydrogen through duct 52. This hydrotreatment zone 46 also receives, on the one hand, the cut discharged through duct 32 from zone 29 for fractionating the products discharged from the polymerization zone 17 and eventually, on the other hand, the bottom product, discharged through duct 39, from the fractionation zone 35 for the products discharged from the alkylation zone 33. The hydrotreatment is carried out at a temperature between about −20° and +450° C. under a pressure between about 1 and 90 kg/cm$^2$, with a ratio $H_2$/HC between about 0.05 and 3 and in the presence of a conventional hydrogenation catalyst. The product from the hydrotreatment zone 46 is passed through duct 47 to the fractionation zone 48 to recover:

- a gaseous light cut containing an excess of the hydrogen fed through pipe 52 to the hydrotreatment zone 46; it is discharged through pipe 54,
- a kerosene cut discharged through duct 49,
- a gas oil cut discharged through duct 50,
- bottoms which can be at least partly recycled to cracking zone 8 through duct 51.

EXAMPLE

By way of example, the three following cuts, discharged from a Fischer-Tropsch synthesis unit, are admixed to constitute 100% of the total charge to be treated according to the invention.

- a light cut consisting of hydrocarbons having from 3 to 6 carbon atoms per molecule, this cut also containing carboxy compounds and amounting to 44.6% b.w. of the total charge to be treated.
- a previously called "light oil" cut containing hydrocarbons and oxygen-containing hydrocarbon molecules. This cut comprises molecules ranging from those having at least 5 carbon atoms per molecule up to those having an ASTM final distillation point of about 300° C. It represents 46.2% b.w. of the total charge to be treated according to the process of the invention.
- a cut known as "decanted oil" consisting of a mixture of hydrocarbons and hydrocarbon molecules containing combined oxygen, which have a distillation range from about 300° C. to 500° C. This cut represents 9.2% b.w. of the total charge to be treated by the process of the invention.

According to the process of the invention, the light cut is first subjected to distillation in zone 4 (FIG. 1 is again concerned) in order to remove through pipe 5 the hydrocarbons having less than 2 carbon atoms per molecule (in our example, they amount to 0.1% b.w. of the charge) and also to remove a residue containing hydrocarbons with more than 5 carbon atoms and carboxy molecules (i.e., in the present example, 11.5% b.w. of the total charge). These column bottoms are discharged through duct 7 and treated with the two other cuts of the total charge, i.e. the light oils and decantation oils, in the FCC decarboxylation zone 8.

At the outlet from the separation zone 4, there is obtained, in pipe 6, a cut containing only $C_3$ and $C_4$ hydrocarbons, which represents 33% b.w. of the total charge to be treated according to the process of the invention.

This cut has a high $C_3$ and $C_4$ olefin content; its unsaturated hydrocarbon content is 68% b.w., i.e. 22.4% b.w. of the total charge. This cut is passed to a catalytic polymerization unit 12 of the "polynaphtha" type, so as to convert the light olefinic hydrocarbons to gasoline and middle distillates. This cut is passed to the polymerization zone 17 in admixture with the cut of pipe 12, as obtained from a zone 10 for fractionating the effluent from the cracking zone 8, as hereunder explained. The mixture of pipes 6 and 12 which amounts to 38.4% of the total charge treated according to the invention is relatively light and has a relatively large olefin content, since the $C_3$–$C_4$ fraction of pipe 6 contains 69% b.w. thereof and the fraction of pipe 12 contains 67.5% b.w. of olefins.

The operating conditions in the polymerization zone 17 are as follows:

volume volocity: 2 volumes of charge per volume of catalyst per hour
temperature: 200° C.
pressure: 40 bars
The catalyst is silica-alumina in the form of balls.

The products discharged from the polymerization zone 17 are supplied to the fractionation column 29, from where are discharged:

- ($\alpha$) from the top of the column, through pipe 30, gaseous products containing hydrocarbons with less than 5 carbon atoms per molecule, i.e. mainly $C_2$ and $C_4$ hydrocarbons; this fraction amounts to 14.6% of the total charge treated according to the invention and 38% of the charges subjected to polymerization.
- ($\beta$) a $C_5$ - 200° C. gasoline fraction, through duct 31, which amounts to 18.6% of the total amount of the charge treated according to the invention and 48.5% of the charges subjected to polymerization. To upgrade this fraction, it is passed through pipe 31 to zone 40 to be hydrotreated.
- ($\gamma$) column bottoms, through pipe 32, which amount to 5.2% b.w. of the total initial charge and 13.5% of the charges subjected to polymerization. These column bottoms consist of products having a distillation point higher than 200° C.; they are subjected to hydrotreatment and distillation in admixture with the fraction from duct 15, as hereinafter explained, in order to obtain a kerosene and a gas oil cut.

The gaseous products of pipe 30, which consist essentially of hydrocarbons with 3 and 4 carbon atoms per molecule, also contain $C_3$ and $C_4$ olefins which have not polymerized, since the polymerization conversion is not complete and attains about 90%.

In the present example the fraction of duct 30 contains 18.2% b.w. of olefins; it also contains a substantial isobutane amount: 53.2% b.w. in the present case. It is particularly advantageous at this time to subject the cut of pipe 30 to a proper alkylation reaction, to obtain an excellent yield of alkylate, useful as motor gasoline. By this way, it is possible to recover nearly all the olefins and a substantial proportion of the isobutane.

The cut from pipe 30 is alkylated in the presence of hydrofluoric acid which is one of the most selective and easiest to use catalysts its activity is also easy to control. In fact the activity of catalysts of this type decreases versus time, due to the formation of comlexes with diolefins and to their dilution by traces of water introduced with the charge.

It is to be noted that, when working with hydrofluoric acid, a large excess of isobutane in the catalytic alkylation zone limits the secondary polymerization reaction, and also decreases the amount of isobutane to be upgraded as alkylate. Thus, since in the present example there is obtained a large excess of isobutane (51.8% b.w. for 18.2% olefins with 3 or 4 carbon atoms) it is advantageous to recycle at least a portion of this excess to the alkylation reactor 33 through duct 36; in the present example the ratio isobutane/olefins is maintained at a value of about 10, thereby making the alkylation reaction easier, although limiting the formation of heavy products.

Another advantage of the use of hydrofluoric acid is that it remains selective in a temperature range broader than that used with, for example, sulfuric acid, which permits to operate at temperatures compatible with the use of water for cooling (10° and 50° C. with HF and 0° to 10° C. with $H_2SO_4$).

The alkylation is conducted in reactor 33 which is stirred and cooled so as to maintain the temperature of the reaction mixture at 32° C. under a pressure of 14 bars.

i-$C_4$/olefins ratio: 10 volume of HF (85% b.w.) per hour and per olefin volume unit: 2 acid/hydrocarbon volume ratio: 1.

After decantation, separation, washing and distillation in column 35, there is obtained:

1. in pipe 38: 5.80% b.w. (with respect to the total initial charge to be treated according to the invention) of gasoline alkylate, which amounts to 39.7% of LPG fed through duct 30 to the alkylation zone 33.
2. 0.2% b.w. of column bottoms through duct 39.
3. 8.6% b.w. of LPG (duct 38) containing a portion of unreacted isobutane, the other portion of isobutane being recycled to the alkylation reactor 33, through duct 36, in order to maintain an appropriate iso $C_4$/olefin ratio; in this example, the ratio is 10, the portion of recycled isobutane being 45% b.w. of the charge to be alkylated, as supplied from line 30. Since the LPG obtained consists mainly of $C_4$, it may be fed in part or totality to the gasoline pool.

The $C_5$- 200° C. gasoline fraction (the above $\beta$-fraction) recovered from the polymerization step through duct 31 has a very high olefin content; it has the following characteristics:

density 15° C.: 0.739 olefins: 79.5% by volume (3.8% of diolefins); bromine number: 128

$F_1$ octane number (tetraethyl lead — 2 cc per gallon): 94.

Since this gasoline has a high diolefin content, it is necessary to remove these diolefins, in order to make this gasoline usable as high grade gasoline. This removal of diolefins is obtained by selectively hydrogenating this gasoline in the hydrotreatment zone 40. In zone 40, the diolefins react very quickly with minimal lowering of the octane number.

This selective hydrogenation is carried out with a catalyst of the trade (Procatalyse LD 265 type) which is a palladium-on-alumina catalyst whose particle size is 3 mm.

The operating conditions are the following:

pressure: 60 bars temperature: 190° C.

hydrogen/hydrocarbon ratio: 0.2 volume velocity expressed as volume of charge/-volume of catalyst: 1.5.

A strict control of the hydrogen supply permits to stop at an optimal point: maximum removal of diolefins, so as to obtain a potential and actual gum contant lower than the standard value, while retaining sufficient octane number and lead susceptibility; the hydrotreatment is so controlled as to obtain a hydrogenation rate of about 80%.

The useful final product has the following properties:

density at 15° C.: 0.736

$F_1$ octane number (lead — 2 cc per gallon): 93.4.

There is thus obtained, according to the invention, a gasoline content amounting to 18.6% b.w. of the total treated charge.

The bottoms of the distillation column 4 are fed to the FCC decarboxylation zone 8 as explained above. The two light oil and decanted oil cuts are also introduced into zone 8 through the respective ducts 2 and 3.

The mixture of the 3 fractions of ducts 7, 2 and 3 supplied to zone 8 has, in the present example, the following properties:

| | |
|---|---|
| density at 15° C | 0.785 |
| bromine number (g/100 g) | 79 |
| acid number (mg KOH/g) | 5.8 |
| distillation: initial point | 33° C |
| 50% point | 171° C |
| final point | 510° C |
| % distilled | 98.5 |

This charge, amounting to 66.9% b.w. of the total amount of the products treated according to the present invention, is thus contacted in zone 8 with a solid catalyst which, in the present case, is synthetic alumina-silica containing 85% $SiO_2$ and 15% of $Al_2O_3$.

The operating conditions are:

volume volcity: 4 volumes of liquid charge per volume of catalyst per hour temperature: 460° C.

pressure: atmospheric.

The products discharged from reactor 8 are cooled; at this moment, the acid number, which was 5.8 (mg KOH/g) before the FCC step, becomes lower than 0.01, which shows the effect of decarboxylation. The products discharged through pipe 7 are then fractionated (zone 10) to obtain 5 cuts:

(a) a gaseous cut (duct 11) containing hydrocarbons with less than 3 carbon atoms per molecule. This cut amounts to about 0.3% by weight of the whole amount of the products to be treated, i.e. the initial charge, and 0.45% of the charge supplied to FCC 8, without taking into account recycling from subsequent hydrotreatment through line 51.

(b) a cut comprising hydrocarbons with 3 to 4 carbon atoms per molecule, which represents 5.4% b.w. of the whole charge to be treated. This cut has a high $C_3$ and $C_4$ olefin content: 67.5% b.w. This cut is supplied to the polymerization unit 17 through duct 12, where it is treated in admixture with the $C_3$ and $C_4$ cut discharged through duct 6 from the fractionation of the light $C_3$–$C_4$ cut, as explained above.

(c) a light gasoline cut containing exclusively hydrocarbons with 5 and 6 carbon atoms per molecule and having a high olefinic hydrocarbon content, 89% by weight. More than 93% of these olefins are of the alpha type and have an octane number far lower than that of the other isomers. This cut represents 17.2% b.w. of the total charge and 25.4% of the effluent from zone 8 of the FCC, not taking into account the recycling of duct 51; it has the following properties:

density at 15° C.: 0.663
bromine number: 179
acid number in mg KOH/g: 0.2
research octane number: 78.

This cut is passed through duct 13 to the olefin isomerization zone 19 operated under optimized conditions, in the presence of hydrogen supplied through duct 53, so as to obtain an isomerizate, i.e. a product having an octane number substantially higher than that of the starting material, thus gasoline of outstanding quality. The catalyst used in zone 19 contains 0.3% b.w. palladium on alumina of 200 $m^2/g$ specific surface. This catalyst was previously sulfurized with an organic sulfur derivative (methyl disulfide) so as to inhibit the hydrogenating activity of the metal.

The operating conditions are the following (in zone 19):

| | |
|---|---|
| volume velocity hour | 7 volumes of charge per volume of catalyst per |
| temperature | 100° C |
| pressure | 5 bars |
| $H_2$/hydrocarbon | 0.5 |

A strict control of the hydrogen feed rate and prior sulfurization of the catalyst permit to limit the hydrogenation of olefins to about 6% b.w. while reducing the content of actual and potential gums to a quite satisfactory level.

There is thus obtained at the outlet from the isomerization zone 19, a gasoline cut, amounting to 17.2% b.w. of the total initial charge treated according to the present invention, which has the following characteristics:

density at 15° C.: 0.672
bromine number: 161
research octane number: 92

(d) a heavier gasoline cut discharge through duct 14 and containing hydrocarbons with 7 to 10 carbon atoms per molecule, whose ASTM distillation range is between 80 and 177° C.; this cut amounts to 23.8% b.w. of the total charge to be treated according to the present process and 35.5% b.w. of the effluent from the mixture subjected to FCC of zone 8, not taking into account the recycling of duct 51. This cut has a high olefin content and contains also diolefins and some carboxy compounds.

It has the following characteristics:

density at 15° C.: 0.718
olefins: 76.2% by volume
bromine number: 126
diolefins: about 3.7% by volume.

This cut is first hydrotreated in the presence of hydrogen supplied through duct 23, in zone 21, before being passed to the reforming zone 24 for transformation into high grade gasoline.

The hydrotreatment in zone 21 is effected in the presence of a conventional catalyst (Procatalyse, LD 265 type) of palladium on alumina, whose grain size is 3 mm.

The operating conditions are the following:

pressure: 50 bars
temperature: 190° C.
volume velocity in volume of charge per volume of catalyst: 1.5
$H_2$/HC ratio: 4

The product discharged from the hydrotreatment zone 21 is passed through duct 22 to the reforming zone 24 fed with hydrogen through duct 53, in which zone prevail the following operating conditions:

temperature: adjusted according to the O.N. to be obtained (in the present case: O.N. of 96) and varying in the present example in relation with time from 490° C. up to 530° C.; when the temperature attains 530° C., the operation is discontinued and the catalyst is regenerated.
pressure: 20 bars
$H_2$/hydrocarbons ratio by mole: 5
weight of naphtha/weight of catalyst: 3

There is used a conventional catalyst (Procatalyse, RG 432 type) containing platinum deposited on alumina. It appears as extrudates of 1.2 mm. This catalyst is arranged in fixed bed.

The average yield of $C_5$+ gasoline fraction is 82.2% with respect to the charge introduced into said zone 24, which represents 19.6% of the total charge to be treated according to the present invention. There is also obtained LPG containing 83% of hydrogen to be recyled to the reforming zone 24. The $C_5$+ gasoline fraction of good quality is supplied to the gasoline pool.

(e) a heavier cut comprising hydrocarbons ranging from those with 11 carbon atoms per molecule up to those distilling at 380° C.

This cut amounts to 24.8% b.w. of the total initial charge to be treated and 36.6% of the mixture supplied to the FCC of zone 8.

This cut is discharged through duct 15 from the cracking decarboxylation zone 8, and passed to the hydrotreatment zone 46, together with the bottom effluent discharged through duct 32 from zone 29 for fractionating the products from the polymerization zone 17, and also together with the effluent of duct 39 from the fractionation zone 35 of the products of the alkylation zone 33.

This hydrotreatment has for object to improve the stability, color and odor of the final products and to increase the cetane number of the gas oil cut to be obtained in pipe 50 after further fractionation. This hydrotreatment is effected in zone 46 in the presence of the same catalyst of palladium deposited on alumina which had been used for the hydrotreatment in zone 40.

The operating conditions are as follows:

pressure: 60 bars
temperature: 320° C.
volume velocity: 2 volumes of charge per volume of catalyst per hour.
$H_2$/HC ratio: 5.

After distillation in zone 48 of the resulting products, there is essentially obtained a kerosene cut (200°–250° C.) in duct 49 and a gas oil cut (250°–360° C.) in duct 50.

The kerosene cut (200°-250° C.), which amounts to 8.5% b.w. of the total initial charge treated according to the invention has the following characteristics:

density at 15° C.: 0.820
bromine number: 0.08
smoke point (mn): 32
freezing point ° C.: −70.

The gas oil cut (250°-360° C.), which represents 11.2% b.w. of the total initial charge treated according to the invention has the following properties:

density at 15° C.: 0.860
bromine number: 0.02
pour point (° C.): −57
cetane number: 60

There is also discharged, through duct 51, heavy oil (or bottom residue) which is usefully recycled to zone 8 of FCC cracking. This bottom residue represents 10.5% b.w. of the fresch charges to be treated, i.e. the total charge.

and (f) a residue with coke (duct 16) which amounts to 5.9% of the total charge and 8.82% of the FCC charge, not taking into account the recycling through duct 51. This residue is discharged.

Thus, when treating according to the invention the three complex charges from a Fischer-Tropsch synthesis, there are obtained products of high quality with excellent yields which are given hereunder as % of the total initial charge, i.e. of the three fractions of ducts 1, 2 and 3:

8.4% b.w. of LPG (duct 37): essentially butanes
61.2% b.w. of motor gasoline (ducts 20, 28, 38 and 45)
8.5% b.w. of kerosene (duct 49)
11.2% b.w. of gas oil (duct 50).

What we claim as our invention is:

1. A process for increasing the value of effluents from syntheses of the Fischer-Tropsch type, these effluents being essentially formed of three cuts, the first cut or "light fraction" containing a major portion of hydrocarbons with 3 to 6 carbon atoms per molecule, these hydrocarbons being largely unsaturated ones and also containing oxygen compounds, the second cut or "light oil" containing a major portion of hydrocarbons whose lightest have 5 carbon atoms per molecule and whose heaviest have an ASTM final distillation point of about 300° C., said "light oil" also containing organic oxygen compounds, the third cut or "decanted oil" containing a major portion of hydrocarbons of distillation point between about 300° C. and 500° C. and also containing organic oxygen compounds, in which process the so-called light fraction cut is subjected to fractionation to obtain (a) a gaseous cut of low volume with respect to the light fraction, (b) a cut containing a large proportion of unsaturated hydrocarbons and consisting essentially of hydrocarbons with 3 and 4 carbon atoms per molecule and (c) a cut consisting of $C_5^+$ hydrocarbons and also containing oxygen compounds, to be treated as hereunder stated, in which process the cut (b) of high unsaturated hydrocarbon content is treated in admixture with another cut (b) of condensable gas, as hereinafter defined, in a polymerization zone, in the presence of a catalyst of the acid type, at a temperature between 100° and 400° C. under a pressure between about 1 and 200 kg/cm$^2$, at a liquid hydrocarbon feed rate of about 0.05 to 5 volumes per volume of catalyst per hour, the effluent of the polymerization zone being supplied to a fractionation zone to obtain ($\alpha$) a fraction of high content of relatively light normal and iso olefins and paraffins, ($\beta$) a fraction of high gasoline content, comprising hydrocarbons whose lightest have 5 carbon atoms and heaviest have an ASTM final distillation point of about 200° C. ($C_5^+$ − 200° C.) and ($\gamma$) a fraction of high kerosene and gasoil content, the ASTM final distillation point being higher than about 200° C., in which process and fraction ($\beta$) of high content in relatively light olefins and paraffins is subjected at least in part to an alkylation reaction, the effluent from the alkylation zone being subjected to fractionation to recover (1) at least one light hydrocarbon cut containing isoparaffins and normal paraffins of 3 and 4 carbon atoms per molecule, (2) an alkylate useful as motor gasoline and (3) a residue, in which process said fraction ($\beta$) of high gasoline ($C_5^+$ − 200° C.) content recovered from the fractionation zone following the polymerization zone is treated in a hydrotreatment zone, the effluent from the hydrotreatment zone being supplied to a fractionation zone to recover essentially a motor gasoline cut of high purity, in which process said fraction ($\gamma$) of high kerosene and gas oil content, as recovered from the fractionation zone following the polymerization zone is supplied in admixture with a heavy cut whose origin is defined hereunder and comprising hydrocarbons ranging from those with 11 carbon atoms per molecule up to those having an ASTM final distillation point of 380° C., to a hydrotreatment zone, as hereinafter stated, in which process the so-called "light oil" second cut and the so-called "decanted-oil" third cut, in admixture with said cut (c) of $C_5^+$ hydrocarbons recovered from the fractionation of the said "light fraction" first cut, are supplied to a cracking-decarboxylation zone operated in the presence of an acid catalyst at a temperature between 400 and 1200° C., at a space velocity of 2 to 10 volumes of liquid charge per volume of catalyst per hour, the effluent from the cracking-decarboxylation zone being supplied to a fractionation zone to recover (a) an uncondensable gaseous cut containing hydrocarbons with less than 3 carbon atoms per molecule, (b) a condensable gas cut containing olefins with 3 and 4 carbon atoms per molecule, this cut being supplied to said polymerization zone in admixture with the cut (b) of high unsaturated hydrocarbon content as recovered from the fractionation of the first so-called "light fraction" cut, (c) a light cut containing unsaturated hydrocarbons with 5 and 6 carbon atoms per molecule, that cut (c) being sujected to isomerization at a temperature of from 0° to 400° C. in the presence of a presulfurized catalyst containing an alumina-based carrier and a metal from group VIII of the periodic classification of the elements, so as to obtain a motor gasoline fraction of high purity, (d) a heavy gasoline cut comprising hydrocarbons with 7 to 10 carbon atoms per molecule, said cut (d) being subjected to hydrotreatment to eliminate olefins and oxygen compounds, the effluent from the hydrotreatment being subjected to hydro reforming, the effluent from the reforming being fractionated to recover a gasoline fraction of high quality, (e) a cut comprising hydrocarbons ranging from those with 11 carbon atoms per molecule up to those having an ASTM final distillation point of about 360° C. or more, and (f) a residue of tar and other heavy products, in which process said cut (e) is admixed with said fraction ($\gamma$) of high kerosene and gas oil content recovered from the fractionation zone following the polymerization zone and also with said residue (3) obtained when fractionating the effluent from said alkylation zone, and the mixture supplied to a hydrotreatment zone, the effluent from the hydrotreatment zone being subjected to fractionation to recover (a) a gas fraction, (b) a kerosene fraction, (c) a gas oil fraction and (d) column bottoms.

2. A process according to claim 1, wherein the alkylation reaction is effected in the presence of hydrofluoric acid at a temperature of from −20° to + 200° C. under a pressure of 0.1 to 200 atmospheres, and wherein, after having subjected the effluent from the alkylation zone to fractionation to recover a light hydrocarbon cut containing isoparaffins and normal paraffins, at least a portion of the isoparaffins with 4 carbon atoms per molecule is recycled to the alkylation zone.

3. A process according to claim 1, wherein at least a portion of the residue (3) obtained by fractionation of the alkylation effluent is supplied to the cracking-decarboxylation zone.

4. A process according to claim 1, wherein, in the cracking-decarboxylation zone, it is processed in the presence of an acid catalyst in fluid bed.

5. A process according to claim 1, wherein at least a portion of the column bottoms (d) obtained by fractionation of the effluent from the hydrotreatment zone for said cut (e), said fraction (γ) and said residue (3), is recycled to the cracking-decarboxylation zone.

* * * * *

UNITED STATES PATENT AND TRADEMARK OFFICE

CERTIFICATE OF CORRECTION

PATENT NO. : 4,125,566

DATED : November 14, 1978

INVENTOR(S) : Chan Trin Dinh et al

It is certified that error appears in the above-identified patent and that said Letters Patent are hereby corrected as shown below:

Claim 1, Column 14, line 6: reads "and fraction (β)"

should read -- said fraction (α) --.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*